US006305034B1

(12) United States Patent
Perez Urrutia

(10) Patent No.: US 6,305,034 B1
(45) Date of Patent: Oct. 23, 2001

(54) EXTENSIBLE AND RETRACTABLE URINE DEFLECTING APPARATUS FOR USE WITH A TOILET

(76) Inventor: Jose Miguel Perez Urrutia, 9531 SW. 148 Ave. Cir. East, Miami, FL (US) 33196

( * ) Notice: Subject to any disclaimer, the term of this patent is extended or adjusted under 35 U.S.C. 154(b) by 0 days.

(21) Appl. No.: 09/221,468

(22) Filed: Dec. 28, 1998

Related U.S. Application Data

(60) Provisional application No. 60/090,172, filed on Jun. 22, 1998.

(51) Int. Cl.[7] ..... E03D 9/00

(52) U.S. Cl. ..... 4/300.3; 4/144.2; 4/301

(58) Field of Search ..... 4/300.3, 902, DIG. 5, 4/243.1–243.3, 244.1, 244.2, 245.9, 144.1, 144.2, 481, 484, 301, 310, 311; 248/298.1

(56) References Cited

U.S. PATENT DOCUMENTS

| | | | | |
|---|---|---|---|---|
| 2,094,493 | * | 9/1937 | Peterson | 248/298.1 |
| 2,577,028 | * | 12/1951 | McMorrow | 4/DIG. 5 |
| 2,592,040 | * | 4/1952 | LaHue | 4/144.1 |
| 2,712,654 | * | 7/1955 | Batlas et al. | 4/243.1 |
| 2,980,919 | * | 4/1961 | Otto et al. | 4/301 |
| 3,638,801 | * | 2/1972 | Larson | 248/298.1 |
| 4,282,611 | * | 8/1981 | O'Day | 4/301 |
| 4,612,676 | * | 9/1986 | Whitman | 4/301 |
| 4,975,990 | * | 12/1990 | Chan | 4/245.9 |
| 5,276,925 | * | 1/1994 | Blaha | 4/DIG. 5 |
| 5,323,495 | * | 6/1994 | Han | 4/245.9 |
| 5,373,589 | * | 12/1994 | Rego et al. | 4/DIG. 5 |
| 5,465,431 | * | 11/1995 | Wertz | 4/300.3 |
| 5,722,136 | * | 3/1998 | Jonec | 4/144.1 |
| 5,732,416 | * | 3/1998 | Albert | 4/DIG. 5 |
| 5,901,385 | * | 5/1999 | Nian | 4/484 |

FOREIGN PATENT DOCUMENTS

| | | | | |
|---|---|---|---|---|
| 76382 | * | 8/1894 | (DE) | 4/244.1 |
| 324680 | * | 9/1920 | (DE) | 4/244.2 |
| 2316180 | * | 10/1974 | (DE) | 4/244.1 |

* cited by examiner

*Primary Examiner*—Charles R. Eloshway

(57) ABSTRACT

An extensible and retractable urine deflecting apparatus 10 for use in combination with a toilet and toilet bowl comprising three distinct segments all contiguously connected. Preferably the 1$^{st}$ segment consists of a pair of flush mounted attach, connect, and support structures 12, but may be limited to one. Preferably the 2$^{nd}$ segment consists of a pair of extensible and retractable mechanical arms 14, but may be limited to one. The 3$^{rd}$ Segment consists of a urine deflecting device 16 or any of various methods including but not limited to absorbent paper 50, cascading water 62, stream of air 78, or lightweight mini urinal device 68. The extensible and retractable urine deflecting apparatus 10 readily converts any typical toilet into a fully functional urinal so that a user from a non sitting position may reliably deliver and deposit a stream of urine by first deflecting and then redirecting the urine into the intended inside portion of the toilet bowl in a sanitary fashion. The extensible and retractable urine deflecting apparatus 10 provides a closer target of superior angle. The urinal mode easily converts back to toilet mode and both modes share the same drain.

64 Claims, 10 Drawing Sheets

FIGURE 4
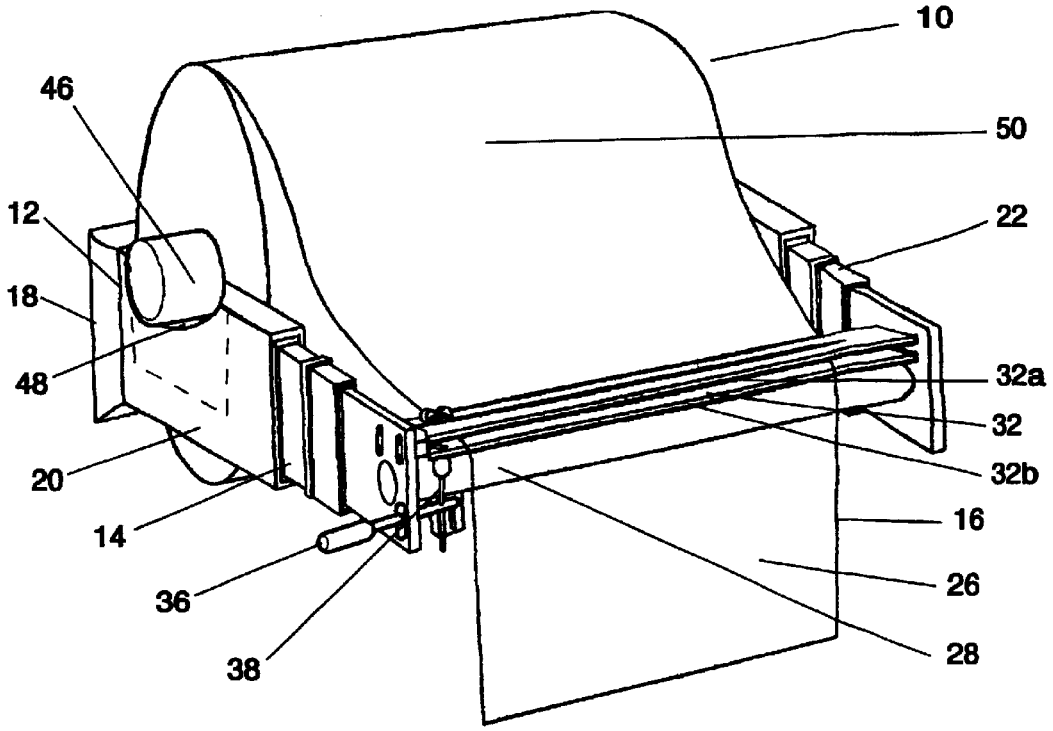
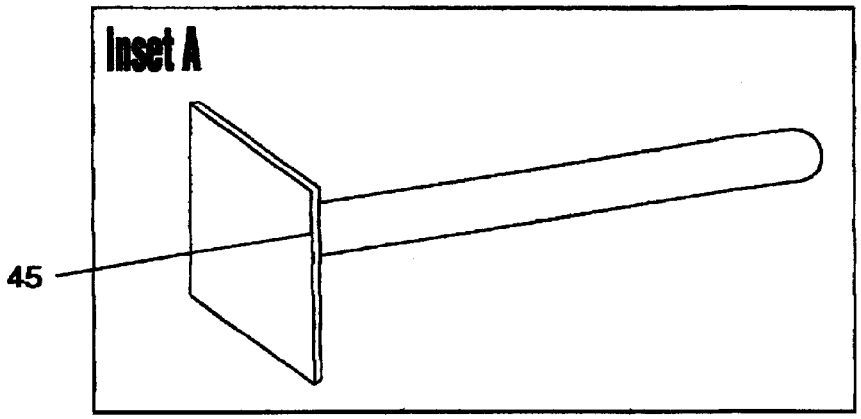
FIGURE 4a

FIGURE 5
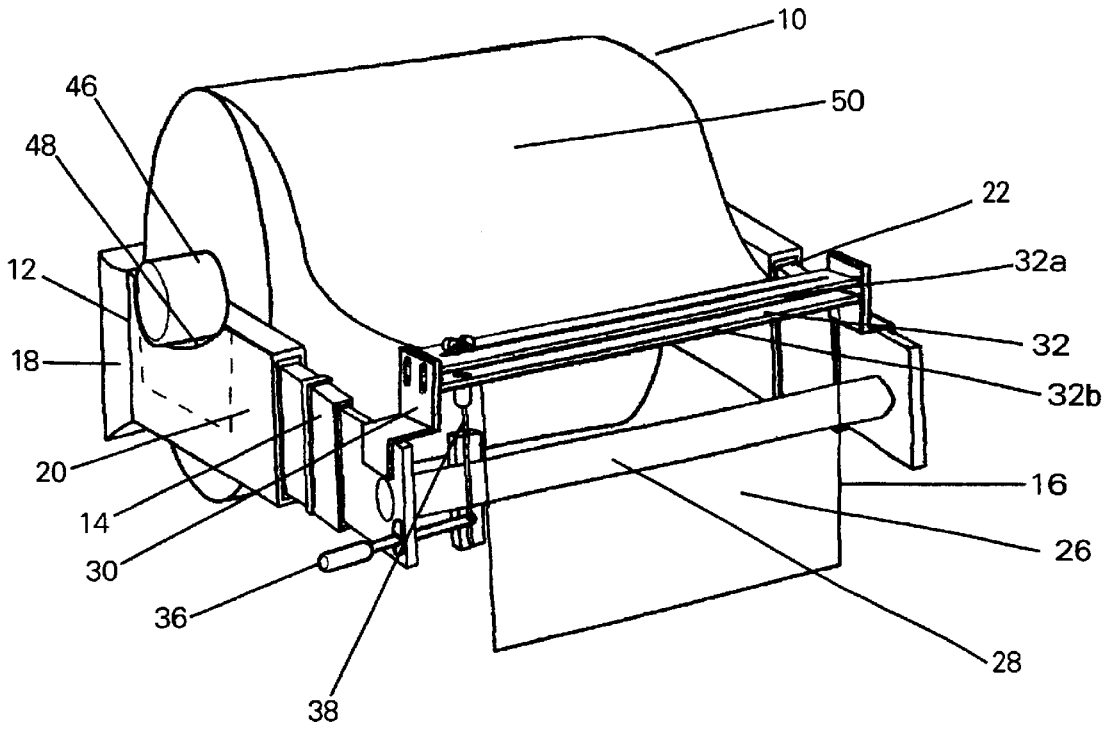
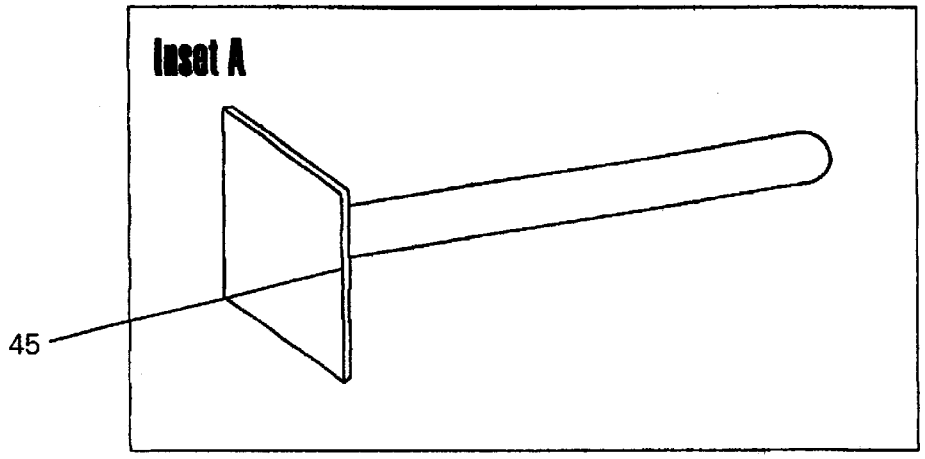
FIGURE 5a

EXTENSIBLE AND RETRACTABLE URINE DEFLECTING APPARATUS FOR USE WITH A TOILET

Related to provisional application Ser. No. 60/090,172 filed on Jun. 22, 1998.

BACKGROUND OF THE INVENTION

1. Field of the Invention

The present invention relates generally to the field of fixtures, devices, and machines in a restroom or a bathroom or any place where a toilet is disposed (hereinafter collectively referred to as a "bathroom") and sanitary waste disposal. More specifically the present invention relates to an extensible and retractable urinal apparatus, which is disposed in proximity to a toilet of any design. It is attached either to the toilet or to a wall, floor, ceiling or any other convenient surface near the toilet (hereinafter referred to as the "attach, connect, and support structure" $1^{st}$ segment.)

The primary purpose of the apparatus is to deflect a stream of urine from a user of the apparatus in a nonsitting position before it can miss the intended inside portion of the toilet bowl and soil the toilet seat or bathroom, and reliably deliver the urine into the bowl. The apparatus includes extension and retraction means secured to the "attach, connect, and support structure". In the preferred embodiment, the apparatus includes two extensible mechanical arms, but any structure (including one such extensible mechanical arm) permitting translational movement may serve as the extension and retraction means. Therefore continuing reference in this specification to extensible arms is not to be construed as a limitation on the structure of said means. A urine deflecting means is secured to the forward ends of the extensible mechanical arms which deflects and delivers into the toilet bowl the stream of urine. The urine deflecting means ($3^{rd}$ segment) may take several different forms. These include, but are not limited to, the following:

(1) A paper dispensing paper clamping, and paper cutting device that positions perpendicularly a portion of paper coming from a spool by immersing the leading edge of the paper in the toilet bowl water and by sandwiching another portion of the paper between a pair of friction engagement pads. The paper dispensing, paper clamping, paper cutting device is placed above the toilet bowl during use providing the user with a precise target of superior angle (absorbent paper) for deflecting and guiding the stream of urine into the toilet bowl.

(2) A paper supporting device that positions perpendicularly a sheet(s) of paper firmly, by utilizing any of various fastening methods which include but are not limited to the following: (a) gripping the sheet of paper from the supporting device, (b) pinning the sheet of paper to the supporting device, (c) hanging the sheet of paper on the supporting device, (d) adhering the sheet of paper to the supporting device, (e) placing the sheet of paper between a magnet(s) and the supporting device. The paper supporting device is placed above the toilet bowl during use providing the user with a precise target of superior angle (Sheet of Absorbent Paper) for deflecting and guiding the stream of urine into the toilet bowl.

(3) A water cascading faucet device with integral components having an elongated sheetflow spout for substantially widening the flow of cascading water positioned perpendicularly. The water is obtained from a water supply line using customary plumbing components such as valves (single or double), flexible inlet tube, handle, aerator, flow restrictor and any other component necessary. The water cascading faucet device is positioned above the toilet bowl during use providing the user with a precise target of superior angle (cascading water) for deflecting and guiding the stream of urine into the toilet bowl.

(4) A mini type urinal receptacle device positioned perpendicularly of small scale and substantially lightweight, having and attached to integral plumbing components, such as a water supply line, valve(s) (single or double), flexible inlet tube, spud, flush valve, flush spreader, non drip tailpiece and any other component necessary. The urinal type receptacle device is positioned above the toilet bowl during use, providing the user with a precise target of superior angle (Mini Type Urinal) for deflecting and guiding the stream of urine into the toilet bowl.

(5) A stream of air generating device with integral components, having an elongated air flow nozzle with vanes, for substantially widening the perpendicularly discharged air stream. The stream of air being discharged through the elongated air flow nozzle is first delivered through a flexible hose connected to customary hand dryer components such as a universal type motor (brushless, capacitator initiated), centrifuge type fan, push button activation, reflective infrared sensor, electrical grounding, dedicated electrical circuit, GFI circuit protection, corrosion resistant parts, electrical wiring conduit, electrostatic proximity sensor, surface mounting method or any other component necessary. Note: May be battery operated. The stream of air discharging orifice (elongated nozzle) is positioned above the toilet bowl during use providing the user with a precise target of superior angle (Stream of Air) for deflecting and guiding the stream of urine into the toilet bowl. And any other device to accomplish the stated objective.

2. Description of the Prior Art

There have long been porcelain urinals in men's public restrooms so that the user need not be seated on a conventional toilet. The urinals, which receive and dispose of a stream of urine, are concave and vertically elongated to be an easy target for the urine stream. A problem with these urinals is that they are too space consuming and expensive to be suited for typical home use. Yet the need for the convenience and sanitary benefit of a urinal in the home remains.

It is thus an object of the present invention to provide a urinal apparatus, which can be secured in close proximity to an existing toilet to reliably deflect urine into the toilet bowl.

It is another object of the present invention to provide such an apparatus which is readily retractable to a highly compact position out of the way of a seated toilet user and readily extendable to its operative position over the toilet bowl when placed in close proximity to the user and thus becoming an easy target, and to deliver the intercepted or deflected urine downwardly into the toilet bowl reliably.

It is still another object of the present invention to provide such an apparatus, which is highly sanitary, very convenient to use, and which does not interfere with seated use of the toilet.

It is also an object of the present invention to provide such an apparatus which can be manufactured for a fraction of the cost of a conventional restroom urinal and which is easily installed with minimal skill.

It is apparent that conventional toilets are designed to effectively receive a human beings excreted impurities from a sitting position. It is also apparent that conventional urinals are designed to effectively receive excreted urine typically from a human being of the male gender from a standing position. However, conventional toilets are not effectively designed for receiving urine delivered by a human being from a standing position.

It is thus an object of the present invention to provide an adaptable commercial/residential urine deflecting apparatus, which can be secured in close proximity to an existing toilet for the purpose of deflecting a stream of urine into the toilet bowl.

It is another object of the present invention to provide a urine deflecting apparatus of such range that it can become highly compact and non obstructive to a seated user or it can become extensible and usable as a urine defecting device by a standing user for depositing urine into a toilet bowl.

Other advantages of the present invention extensible and retractable commercial/residential urine deflecting apparatus are:

Toilet remains unaltered. Any existing toilet bowl and drain opening can be utilized to promptly and effectively create a fully functional urinal.

Most existing conventional toilets equipped with water supply, water tank, toilet bowl, integral flush valve, and drain can be converted promptly and effectively into a fully functioning urinal. The urinal mode can also be transformed back to toilet mode promptly, easily, and effectively.

The ability of this novel invention to do that can enable any homeowner to install and have a urinal device/apparatus in any or every bathroom in his or her home, simply, compactly, and inexpensively.

Many commercial buildings frequently visited by the public as well as commercial airlines, trains, buses, recreational vehicles, hotels, hospitals, restaurants, stadiums, arenas, learning institutions, etc. do not have conventional urinals in their bathrooms. They could all benefit by installing a urinal device/apparatus without the expense and cumbersome task of demolishing floors and walls, hiring master plumbers, acquiring special permits, refurbishing esthetics, disposing of debris, etc.

Without a doubt the aforementioned urinal device/apparatus properly positioned provides a closer target at a superior angle therefore maintaining the area around any frequently used conventional toilet more sanitary than if you attempt to use a conventional toilet as you would a conventional urinal.

Other objects and advantages will be apparent to those skilled in the art upon reference to the following descriptions and drawings.

SUMMARY OF THE INVENTION

The present invention accomplishes the above-stated objectives, as well as others, as may be determined by a fair reading and interpretation of the entire specification. A retractable urinal apparatus is provided which is disposed in proximity to a toilet of any design. It is secured in such proximity using an attach, connect, and support structure ($1^{st}$ segment).

In the preferred embodiment, the apparatus includes a pair of longitudinally extensible mechanical arms ($2^{nd}$ segment) secured at their rearward ends to the attach, connect, and support structure ($1^{st}$ segment) or both segments (1&2) can be fabricated of unitary single member construction. A urine deflecting means ($3^{rd}$ segment) is secured to the forward ends of the mechanical arms ($2^{nd}$ segment) which deflects and delivers urine into the toilet bowl. The extensible mechanical arms ($2^{nd}$ segment) may operate by any position translating means, including but not limited to linear telescoping, hinged motion, pivot, linear accordion motion, swivel, or combination movements.

In the preferred embodiment the attach, connect, and support structure ($1^{st}$ segment) preferably is mechanically fastened over the toilet tank (in the case of a conventional toilet).

In the preferred embodiment, the extensible mechanical arms ($2^{nd}$ segment) preferably are positioned over the toilet tank during non use and extend over the toilet bowl during use (in the case of a conventional toilet), and the urine deflecting means ($3^{rd}$ segment) preferably includes absorbent paper dispensed from a device such as a spool wherein the leading edge of the paper is immersed in toilet bowl water for the purpose of maintaining the perpendicularly positioned paper taut. It further preferably includes a spool mounting mechanism removably connected to the attach, connect, and support structure ($1^{st}$ segment), a spool of paper rotatably mounted onto the spool mounting mechanism, and a paper clamp, paper cut, paper guide mechanism ($3^{rd}$ segment) for guiding a portion of the paper extended from the spool downwardly into the toilet bowl. The urine deflecting apparatus preferably includes an attach connect, and support structure ($1^{st}$ segment), preferably includes telescoping extensible mechanical arms with ball bearing mechanism ($2^{nd}$ segment), preferably includes pillars or struts connector member(s) ($3^{rd}$ segment) extending in any of various directions including upwardly from each of the extensible mechanical arms ($2^{nd}$ segment) and a paper mounting and bridging member being optionally removable and secured to the pillars or struts connector member(s) ($3^{rd}$ segment), a paper mounting spindle rotatably fitted and preferably supported by the attach, connect, and support structure ($1^{st}$ segment) and braced substantially between the attach, connect, and support structure, a spool of absorbent paper removably mounted over and around the spindle to unravel over the top or under the underside of the spool, a paper engaging structure ($3^{rd}$ segment) bridging and connecting the forward ends of the extensible mechanical arms ($2^{nd}$ segment) optionally including upwardly extending connector brackets ($3^{rd}$ segment), and a pair of opposing and loosely meeting friction or traction producing engagement plates ($3^{rd}$ segment)fastened to the connector brackets ($3^{rd}$ segment)and optionally a bracing guide member attached adjacent to the paper engaging structure ($3^{rd}$ segment) and the forward ends of the extensible arms ($2^{nd}$ segment)for the purpose of producing simultaneous linear motion between both extensible mechanical arms ($2^{nd}$ segment). Paper from the spool is unrolled forwardly and fitted between the friction engagement plates, which press against the paper to create traction or friction between the plates and the paper. This prevents unwanted and inadvertent dispensing of the paper. A segment of the paper is thereby permitted to angle downwardly, ride against the lower friction engagement plate and enter the toilet bowl and contact water in the toilet bowl.

The attach, connect, and support structure ($1^{st}$ Segment) may take several different forms for the purpose of supporting weight and for securing ($1^{st}$ Segment), and also for the purpose of connecting and supporting extensible mechanical arms ($2^{nd}$ Segment) to ($1^{st}$ Segment).

These include, but are not limited to, the following:

(1) Surface mounted hanger(s) with or without plate or flanges for anchoring or fastening.

(2) Surface mounted bracket(s) with or without plate or flanges for anchoring or fastening.

(3) Surface mounted tubing(s) with or without plate or flanges for anchoring or fastening.

(4) Surface mounted housing(s) with or without plate or flanges for anchoring or fastening.

(5) Surface mounted standards with or without plate or flanges for anchoring of fastening.

(6) Surface mounted flanged channel(s) with or without plate or flanges for anchoring or fastening.

(7) Surface mounted flanged track(s) with or without plate of flanges for anchoring or fastening.

(8) Surface mounted combination telescoping hanger(s) or housing(s) with or without plate or flanges for anchoring or fastening.

(9) Surface mounted combination hinged hanger(s) or housing(s) with or without plate or flanges for anchoring or fastening.

(10) Surface mounted combination swivel hanger(s) or housing(s) with or without plate or flanges for anchoring or fastening. And any other device to accomplish the stated objective.

The extensible and retractable mechanical arm(s) ($2^{nd}$ segment) may take several different forms for the purpose of supporting weight, and for connecting to ($1^{st}$ segment attach, connect and support structure) and ($3^{rd}$ segment, urine deflecting device) and for positioning ($3^{rd}$ segment, urine deflective device) above a toilet bowl during use and for reversing the position of ($3^{rd}$ Segment, urine deflecting device) during non-use. These include but are not limited to the following:

(1) Ball bearing slide, mechanical arm.

(2) Ball bearing track, mechanical arm.

(3) Roller slide, mechanical arm.

(4) Roller track, mechanical arm.

(5) Combination hinge, and linear motion slide, mechanical arm.

(6) Combination hinge, and linear motion track, mechanical arm.

(7) Combination swivel, and linear motion slide, mechanical arm.

(8) Combination swivel, and linear motion track, mechanical arm.

(9) Combination pivot, and liner motion slide, mechanical arm.

(10) Combination pivot, and linear motion track, mechanical arm.

(11) Combination turntable, and linear motion slide, mechanical arm.

(12) Combination turntable and linear motion track, mechanical arm.

(13) Combination ($1^{st}$ Segment, attach, connect and support structure) and variable height slide mechanical arm.

(14) Combination ($1^{st}$ Segment, attach, connect, and support structure) and variable height track mechanical arm.

(15) Combination hinge and mechanical arm.

(16) Combination ($1^{st}$ Segment, attach, connect, and support structure) and hinge mechanical arm.

(17) Linear motion roller trolley and track mechanical arm.

(18) Liner motion roller hanger and track mechanical arm.

(19) Pivoting cable carrier mechanical arm.

(20) Pivoting mechanical arm.

(21) Swivel mechanical arm.

(22) Adjustable pivot and spring mechanical arm.

(23) Telescoping mechanical arm(s) with stop mechanisms made of synthetic materials with lubricity such as Delrin/Acetal, Teflon/Tfe, Zytel/Nylon.

(24) Variable height extensible and retractable urine defecting apparatus.

(25) Variable height track system.

(26) Variable height ($1^{st}$ Segment attach, connect, and support structure)

(27) Variable height ($2^{nd}$ Segment extensible and retractable mechanical arms)

(28) Variable height ($3^{rd}$ segment urine deflecting means)

(29) Combination variable height track, and ($1^{st}$ segment, attach, connect, and support structure)

(30) Combination variable height ($1^{st}$ Segment attach, connect, and support structure) and ($2^{nd}$ segment extensible and retractable mechanical arm)

(31) Extensible and retractable robotic mechanical arm and any other suitable mechanical arm.

The mechanical arms ($2^{nd}$ segment) can be made extensible and retractable by utilizing components, including but not limited to the following:

(1) telescoping devices (2) slides (3) tracks (4) channels (5) trolley assemblies (6) roller hangers (7) locks and stops (8) hinges (9) scissor hinges (accordion)

(10) housing(s)

(11) support structures

(12) springs

(13) tubing

(14) pulleys

(15) cables

(16) levers

The mechanical arms ($2^{nd}$ segment) can be made extensible and retractable by utilizing various mechanisms, including but not limited to the following:

(1) ball bearings (2) roller bearings (3) synthetic bearings (Delrin, Teflon, Nylon)

(4) wheels (5) rollers (6) springs (7) high lubricity materials (8) pulley and cable (9) levers Bearings which can be ball bearing mechanized, roller bearing mechanized, synthetic bearing mechanized or any other suitable bearing system.

The mechanical arms ($2^{nd}$ segment) can be made extensible and retractable by utilizing various motions including but not limited to the following:

(1) linear (2) hinge (3) swivel (4) pivot (5) spring (6) accordion (7) rotational (8) gliding (9) rolling The urine deflecting device ($3^{rd}$ segment) may take several different forms for the purpose of conveniently and sanitarily intercepting, deflecting, and depositing urine delivered by a user in a non standing position into a toilet bowl. These include but are not limited to the following: SEE BACKGROUND OF THE INVENTION (1) Paper dispensing, paper clamping, and paper cutting device (2) Paper supporting device (3) Water cascading faucet device (4) Mini type urinal receptacle device (5) Stream of air generating device

BRIEF DESCRIPTION OF THE DRAWINGS

Various other objects, advantages, and features of the invention will become apparent to those skilled in the art from the following discussion taken in conjunction with the following drawings, in which:

FIG. 4 is a close-up view of the apparatus of FIG. 3.

FIG. 4*a* is a close up view of the spool supporting shaft within FIG. 4.

FIG. 5 is a close-up view of the apparatus of FIG. 3 having subtle differences with FIGS. 3–4.

FIG. 5*a* is a close up view of the spool supporting shaft within FIG. 5.

DETAILED DESCRIPTION OF THE PREFERRED EMBODIMENTS

Figure 1:
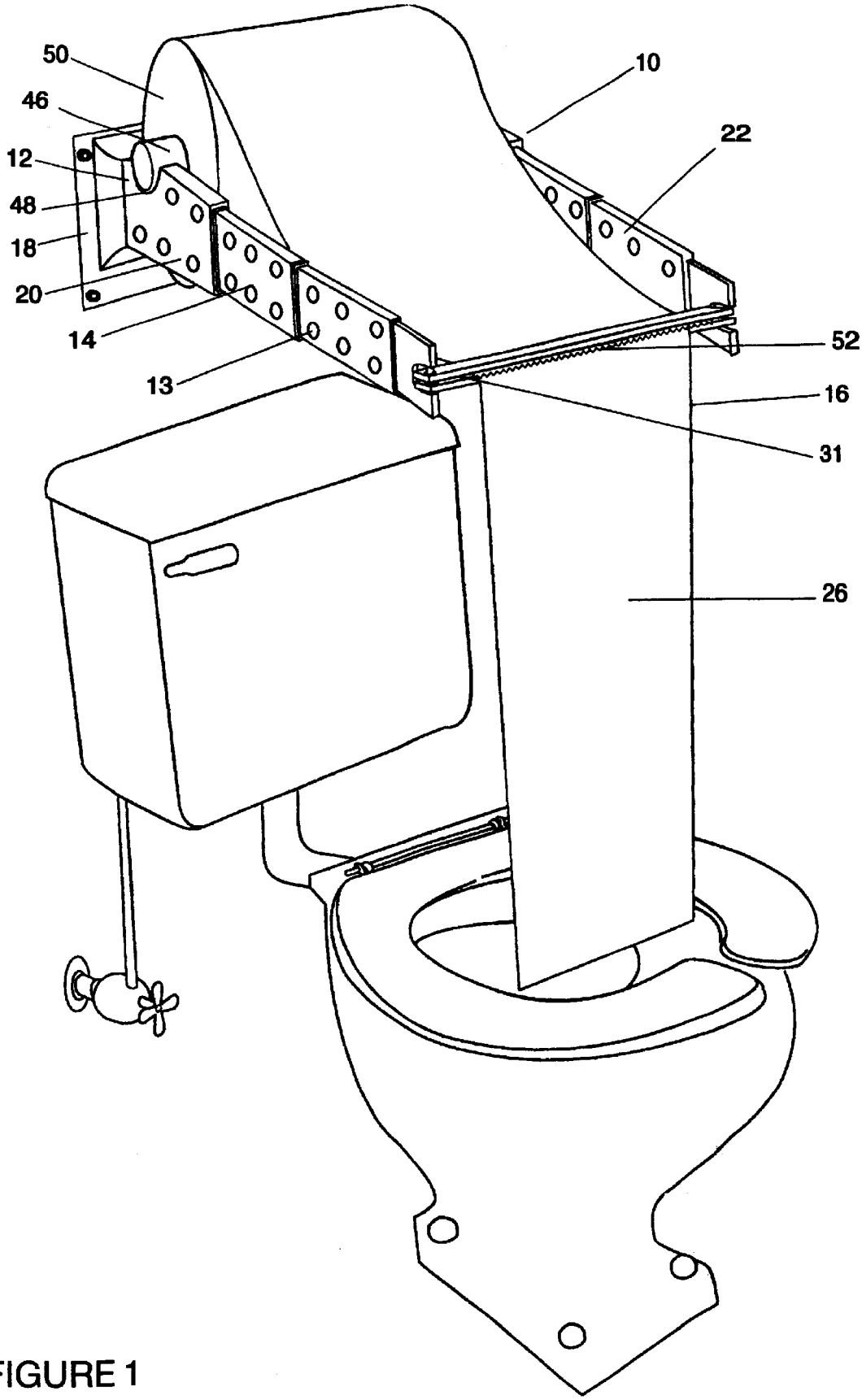
FIGS. 1–3 are perspective views (having subtle differences) of the first preferred embodiment of the invention, shown mounted over a conventional toilet.
Figure 2:
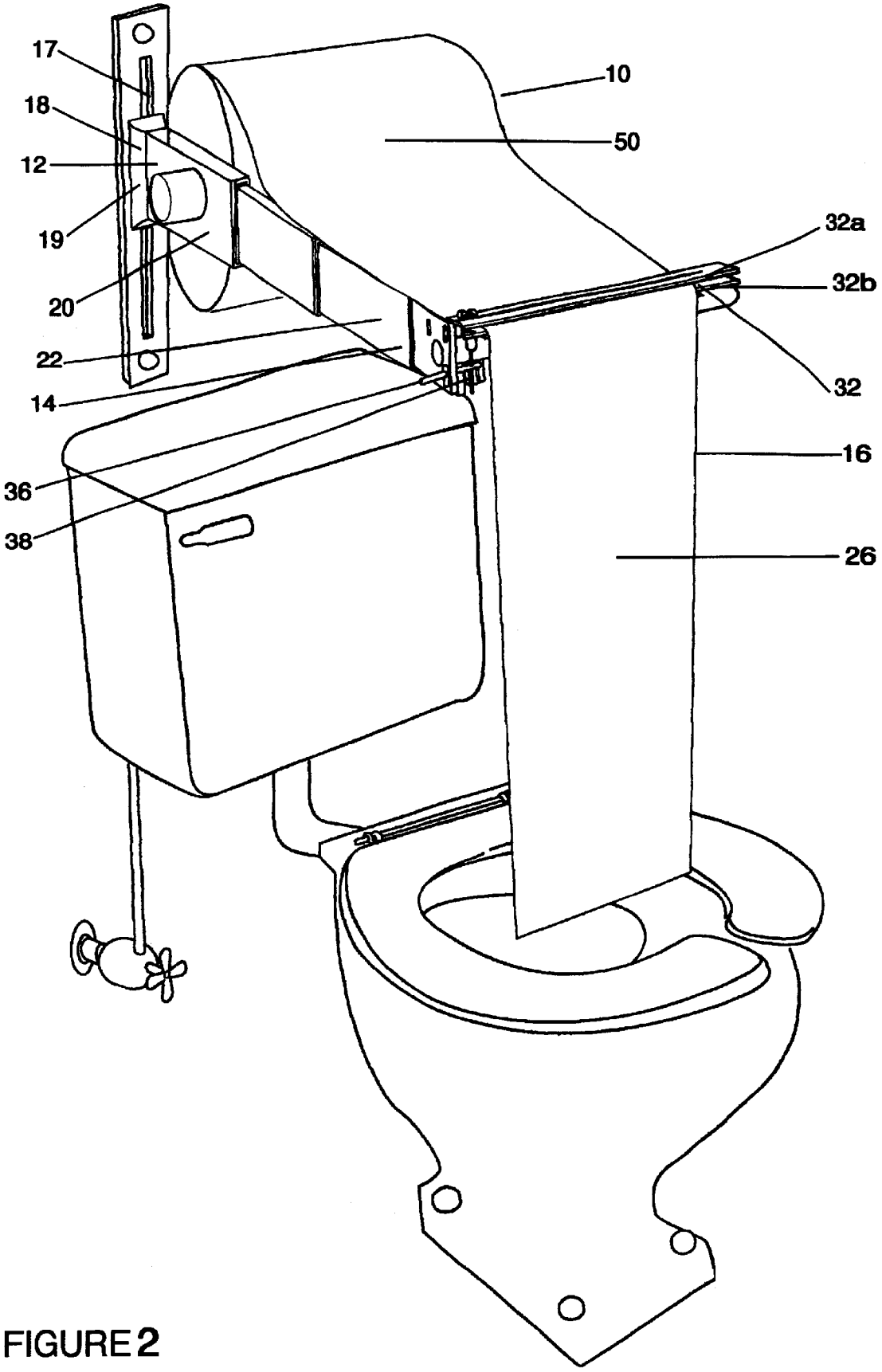
Figure 3:
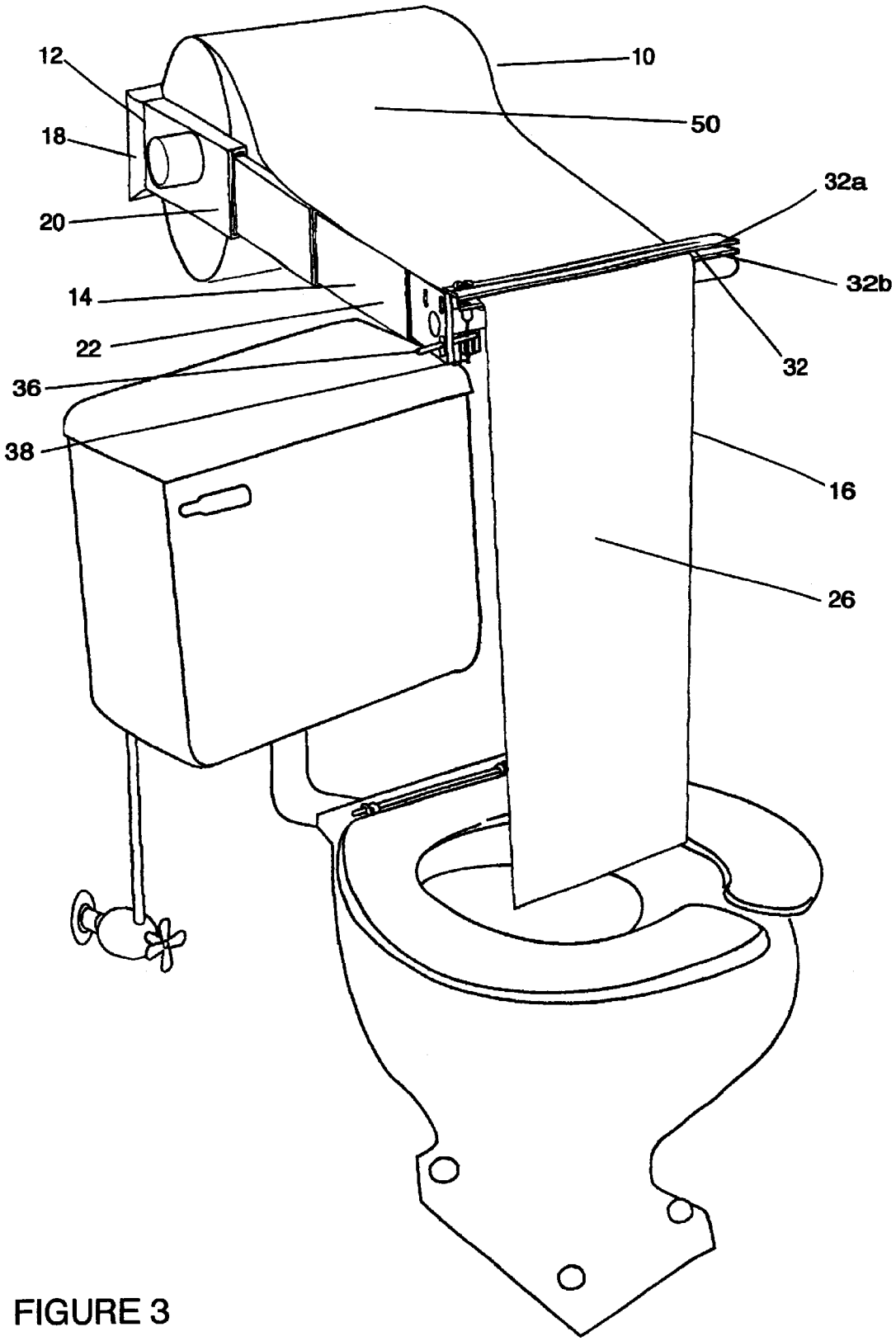

Detailed embodiments of the present invention are disclosed herein; however, it is to be understood that the disclosed embodiments are merely exemplary of the invention which may be embodied in various forms, placed in various locations and used with different types of toilets. Therefore, specific structural and functional details disclosed herein are not to be interpreted as limiting, but merely as a basis for the claims and as a representative basis for teaching one skilled in the art to variously employ the present invention in virtually any appropriately detailed structure and using a variety of materials and components.

Reference is now made to the drawings, wherein like characteristics and features of the present invention shown in the various Figures are designated by the same reference numerals.

FIRST PREFERRED EMBODIMENT

Referring to FIGS. 1–5, an extensible and retractable urine deflecting apparatus 10 comprising an attach, connect, and support structure(s) 12 extensible and retractable mechanical arm(s) 14 and a urine deflecting device 16. A variable height track system 17 or a combination variable height track system with attach, connect, and support structure 19 can be incorporated as part of the urine deflecting apparatus 10. The attach, connect, and support structure(s) 12 comprises a plate or flange 18, or other portion of substantially rigid surface material suitable for securely anchoring or fastening to a convenient surface including but not limited to a wall, floor, ceiling, or toilet itself. Additionally the attach, connect, and support structure 12 has a protruding unit 20 for connecting and adjoining, and for supporting extensible and retractable mechanical arms 14 and any preferred ($3^{rd}$ segment), or member, and/or components, firmly attached to the forward ends of extensible and retractable mechanical arms 14. The extensible and retractable mechanical arm(s) 14 comprise preferably four linear motion telescoping sections, telescoping channels, or telescoping members 22 slidably connected, preferably utilizing ball bearing mechanism, roller bearing mechanism (not shown), or synthetic bearings such as teflon or delrin, and having a lock or stopper mechanism (not shown) including but not limited to a flange, a bumper, or cushion. The extensible and retractable mechanical arm(s) 14 contiguously connect at its rearward end(s) identified as rear section telescoping member(s) 24*a* to the attach, connect, and support structure 12 and the extensible and retractable mechanical arm(s) 14 contiguously connect at its forward end(s) identified as forward section telescoping member 24*d* to the urine deflecting device 26 ($3^{rd}$ segment). The urine deflecting device 26 comprises a structural bridging or bracing member 28 contiguously fastened to a portion of the forward ends of both extensible and retractable mechanical arms 14 identified as forward section telescoping member(s) 24*d*. A pair of upwardly extending pillars or struts 30 contiguously connected to a portion of the forward ends of both extensible and retractable mechanical arms 14 identified as forward section telescoping members 24*d* and also contiguously connected to both ends of the structural bracing member 28. A pair of traction or friction engagement plates or friction engagement pads 32 or paper weight engagement pads/gripping pads 31 both contiguously connected at both of its ends to an upper portion of both upwardly extending struts 30 or contiguously connected to at least one extensible and retractable mechanical arm 14 or smooth surfaced tube(s) 34 The top friction engagement pad 32*a* may remain stationary or vice versa. The bottom friction engagement pad 32*b* is movable and loosely connected underneath the top friction engagement pad 32*a* or vice versa. A pair of upright extending smooth surfaced cylinder shaped pins, smooth surfaced rods, or smooth surfaced tubes 34 are contiguously connected to an upper portion of both upwardly extending struts 30 and may serve to both loosely connect and to facilitate upward motion of the bottom friction engagement pad 32*b* enabling it to press up against the top friction engagement pad 32*a* when interconnecting clamping arm 36 is pushed. A manual push and pull straight line action clamp 38 with clamping arm 36 having an upright positioned sliding bar, sliding plunger, or sliding bolt 40 with centering attachment 42 is employed. The base 44 of the straight line action clamp 38 adjoins and is fastened to at least one upwardly extending strut 30. The end portion of the upright positioned component identified as sliding bolt 40 with centering attachment 42 can be placed in proximity or contiguously connected to the bottom friction engagement pad 32*b*. A removable tube or shaft 46 connected to indentations or niches 48 of both attach, connect, and support structures 12 for inserting through and for supporting a rotatable spool of absorbent paper 50. The leading edge of the absorbent paper 50 is inserted and passed through the friction engagement pads 32. A substantial portion of the absorbent paper 50 is lowered in a perpendicular position and the leading edge of the absorbent paper 50 is immersed into the toilet bowl water. The interconnecting friction engagement pads 32 are in lock position. A serrated blade 52 a circular blade and any other suitable blade contiguously attached to the top friction engagement pad for cutting and removing used portion of absorbent paper 50.

Figure 6:
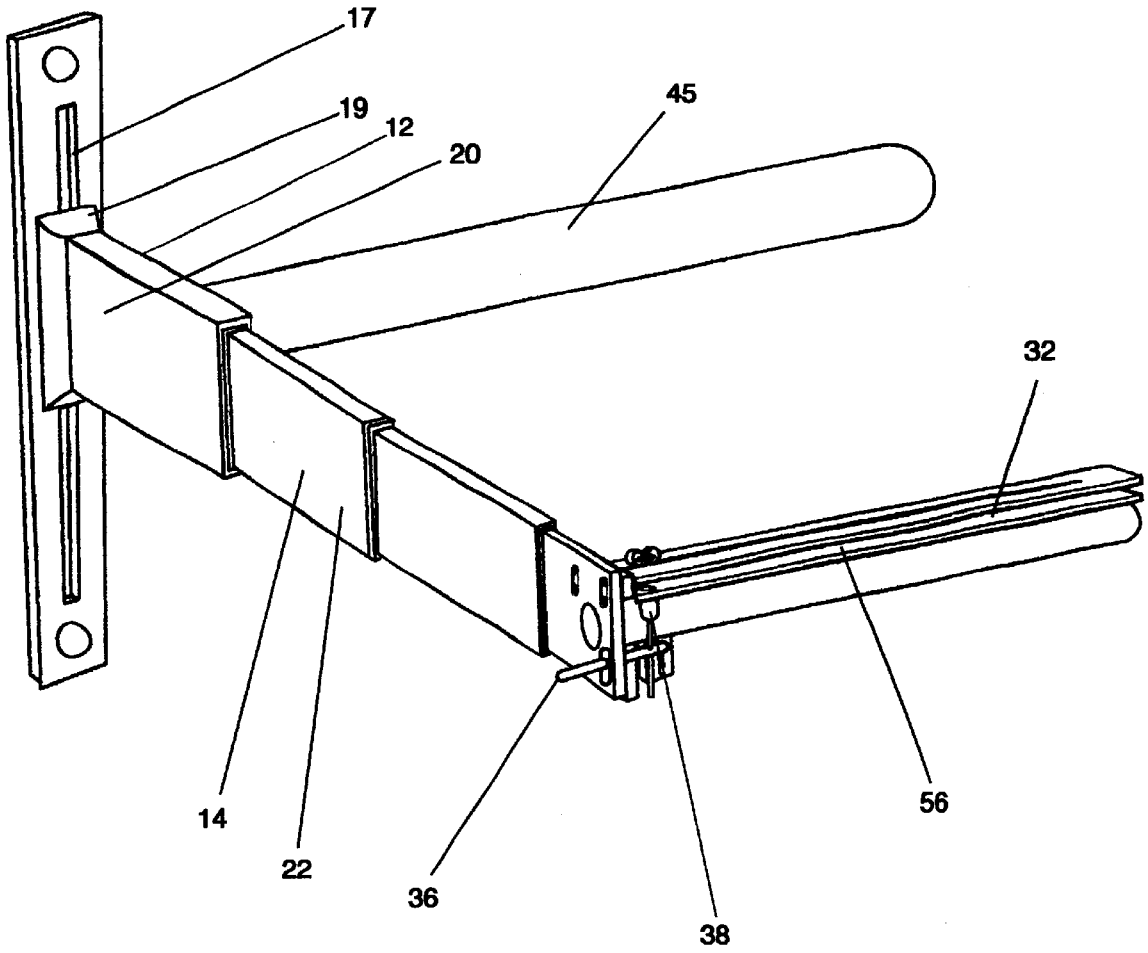
FIG. 6 is a close-up view of the device for supporting and positioning a urine deflecting means ($3^{rd}$ segment) or a spool of absorbent paper ($3^{rd}$ segment)

Referring to FIG. 6. Also referring to FIGS. 1–2 when component spool of absorbent paper 50 from ($3^{rd}$ segment) is incorporated.

The components of ($3^{rd}$ segment) may be replaced, and the alternate components may be arranged in the following order:

A pair of friction or gripping engagement pads 32 or paper weight engagement pads/gripping pads 31 are contiguously connected from both ends to a pair of upright extending smooth surfaced tubes 34. The pair of upright extending smooth surfaced tubes are separately and contiguously connected to the ends of at least one extensible and retractable mechanical arms 14 identified as forward section telescoping members 24*d*. Optionally a single or a pair of clamps 54 are separately and contiguously connected from their base (not shown) to both ends of at least one extensible and retractable mechanical arms 14 identified as forward section telescoping members 24*d* and optionally a single or both clamps are contiguously connected at their gripping ends to both friction or gripping engagement pads 32 or paper weight engagement pads/gripping pads 31. A variable height track system 17 or a combination variable height track system with attach, connect, and support structure 19 can be incorporated as part of the urine deflecting Apparatus 10.

Second Preferred Embodiment

Referring to FIGS. 1–5

The embodiment of extensible and retractable urine deflecting apparatus 10 is comprised of three distinct segments namely (attach, connect, and support structure, $1^{st}$ segment) 12 (extensible and retractable mechanical arms, $2^{nd}$ segment) 14 and (spool of absorbent paper 50 interacting with paper dispensing, paper clamping, and paper cutting mechanism all converging to produce urine deflecting device 16 or $3^{rd}$ segment).

Figure 7:
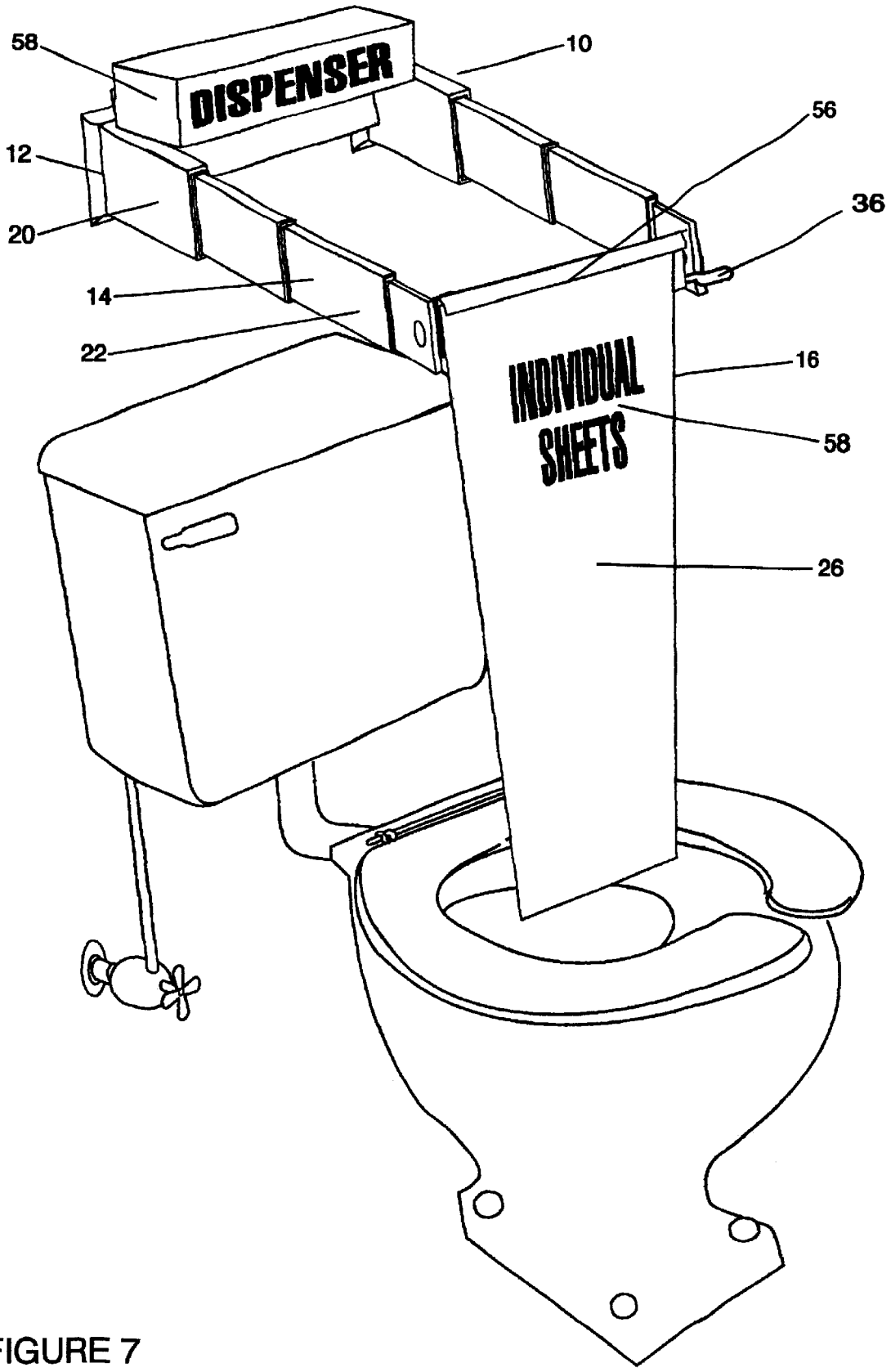
FIG. 7 is a perspective view of the second preferred embodiment of the invention, shown mounted over a conventional toilet.

Referring to FIG. 7

Another embodiment of apparatus 10 may be produced by omitting the spool of absorbent paper 50 and interacting components. attached to forward telescoping members 24*d* is an alternative ($3^{rd}$ segment paper supporting device) 56 that positions perpendicularly a sheet(s) of paper 58 firmly, by utilizing any of various fastening methods which include but are not limited to the following: (a) gripping the sheet of paper from the supporting device, (b) pinning 60 the sheet of paper to the supporting device, (c) hanging the sheet of paper on the supporting device, (d) adhering the sheet of paper to the supporting device, (e) placing the sheet of paper between a magnet(s) and the supporting device. The paper supporting device is placed above the toilet bowl during use providing the user with a precise target of superior angle (Sheet of Absorbent Paper) for deflecting and guiding the stream of urine into the toilet bowl.

Third Preferred Embodiment

Referring to FIGS. 1–5

The embodiment of extensible and retractable urine deflecting apparatus 10 is comprised of "three distinct segments" namely (attach, connect, and support structure $1^{st}$ segment) 12 (extensible and retractable mechanical arms $2^{nd}$ segment) 14 and (spool of absorbent paper 50 interacting with paper dispensing, paper clamping, and paper cutting mechanism all converging to produce urine deflecting device 16 or $3^{rd}$ segment).

Figure 8:
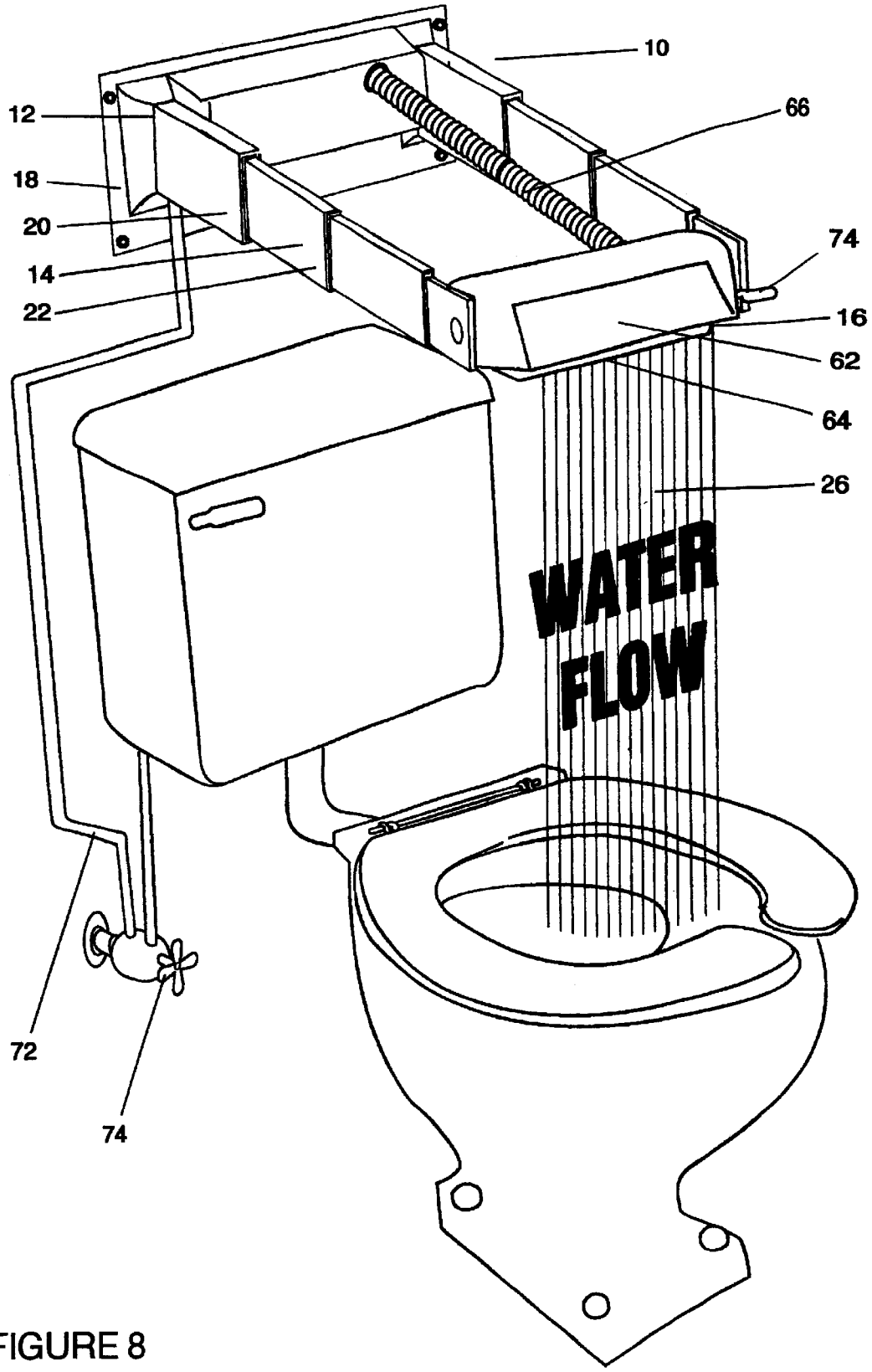
FIG. 8 is a perspective view of the third preferred embodiment of the invention, shown mounted over a conventional toilet.

Referring to FIG. 8

Another embodiment of apparatus 10 may be produced by omitting the spool of absorbent paper 50 and interacting components. Attached to forward telescoping members 24*d* is an alternative ($3^{rd}$ segment water cascading faucet device) 62 with integral components having an elongated sheetflow spout 64 for substantially widening the flow of cascading water positioned perpendicularly. The water is obtained from a water supply line 72 using customary plumbing components such as valves 74 (single or double), flexible inlet tube 66, handle, aerator, flow restrictor and any other component necessary. The water cascading faucet device is positioned above the toilet bowl during use providing the user with a precise target of superior angle (cascading water) for deflecting and guiding the stream of urine into the toilet bowl.

Fourth Preferred Embodiment

Referring to FIGS. 1–5

The embodiment of extensile and retractable urine deflecting apparatus 10 is comprised of "three distinct segments" namely (attach, connect, and support structure $1^{st}$ segment) 12 (extensible and retractable mechanical arms $2^{nd}$ segment) 14 and (spool of absorbent paper 50 interacting with paper dispensing, paper clamping, and paper cutting mechanism all converging to produce urine deflecting device 16 or $3^{rd}$ segment.)

Figure 10:
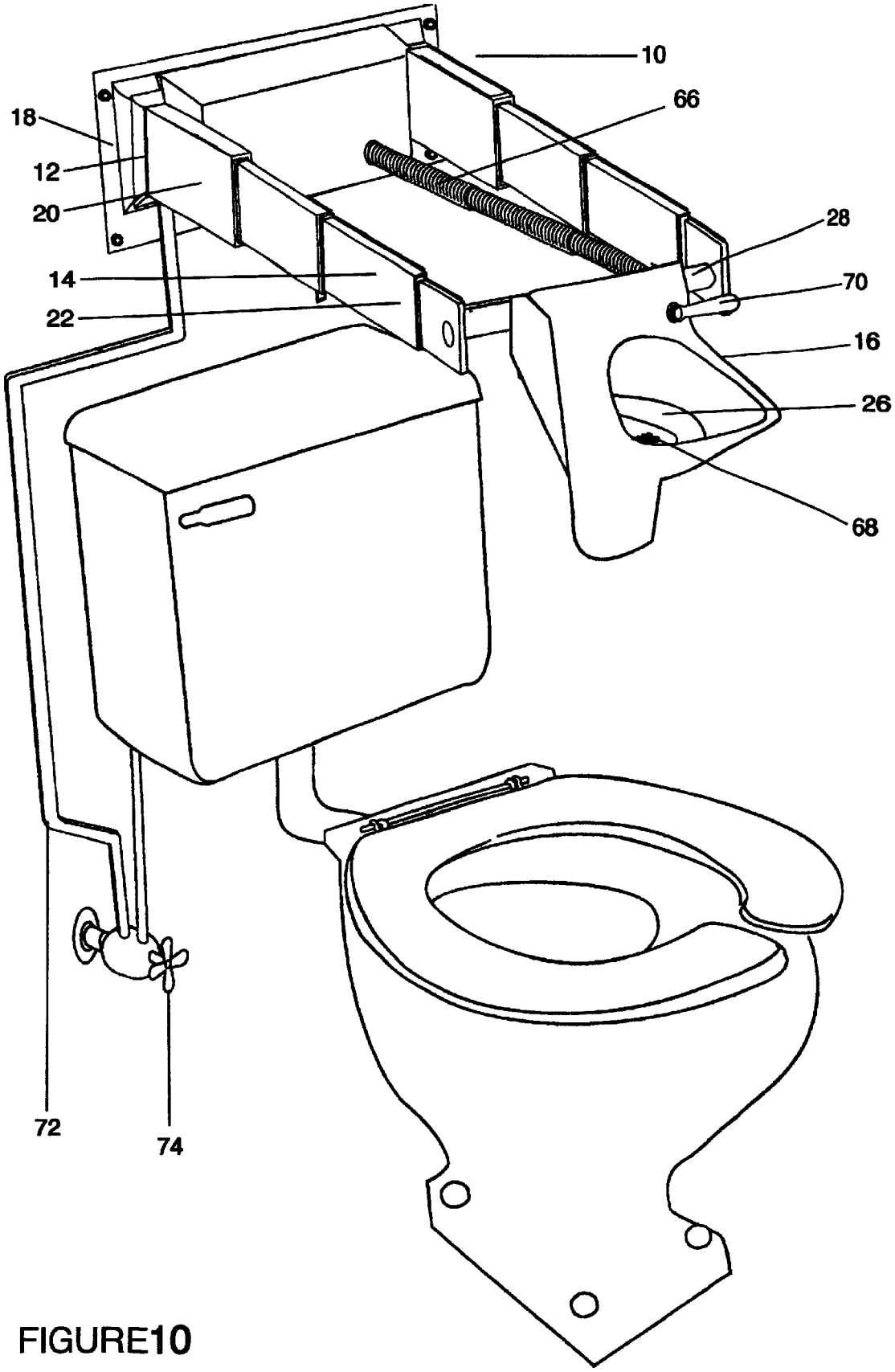
FIG. 10 is a perspective view of the fifth preferred embodiment of the invention, shown mounted over a conventional toilet.

Referring to FIG. 10

Another embodiment of apparatus 10 may be produced by omitting the spool of absorbent paper 50 and interacting components. attached to forward telescoping members 24*d* is an alternative ($3^{rd}$ segment stream of air generating device 76 with integral components, having an elongated air flow nozzle 78 with vanes, for substantially widening the perpendicularly discharged air stream. The stream of air being discharged through the elongated air flow nozzle is first delivered through a flexible hose 80 connected to customary hand dryer components such as a universal type motor (brushless, capacitor initiated), centrifuge type fan, push button activation, reflective infrared sensor, electrical grounding, dedicated electrical circuit 82, GFI circuit protection, cord 84, corrosion resistant parts, electrical wiring conduit, electrostatic proximity sensor, surface mounting method or any other component necessary. Note: May be battery operated. The stream of air discharging orifice (elongated nozzle) is positioned above the toilet bowl during use providing the user with a precise target of superior angle (Stream Of Air) for deflecting and guiding the stream of urine into the toilet bowl. And any other device to accomplish the stated objective.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

Fifth Preferred Embodiment

Referring to FIGS. 1–5

The embodiment of extensible and retractable urine deflecting apparatus 10 is comprised of "three distinct segments" namely (attach, connect, and support structure $1^{st}$ segment) 12 (extensible and retractable mechanical arms $2^{nd}$ segment) 14 and (spool of absorbent paper 50 interacting with paper dispensing, paper clamping, and paper cutting mechanism all converging to produce urine deflecting device 16 or $3^{rd}$ segment).

Figure 9:
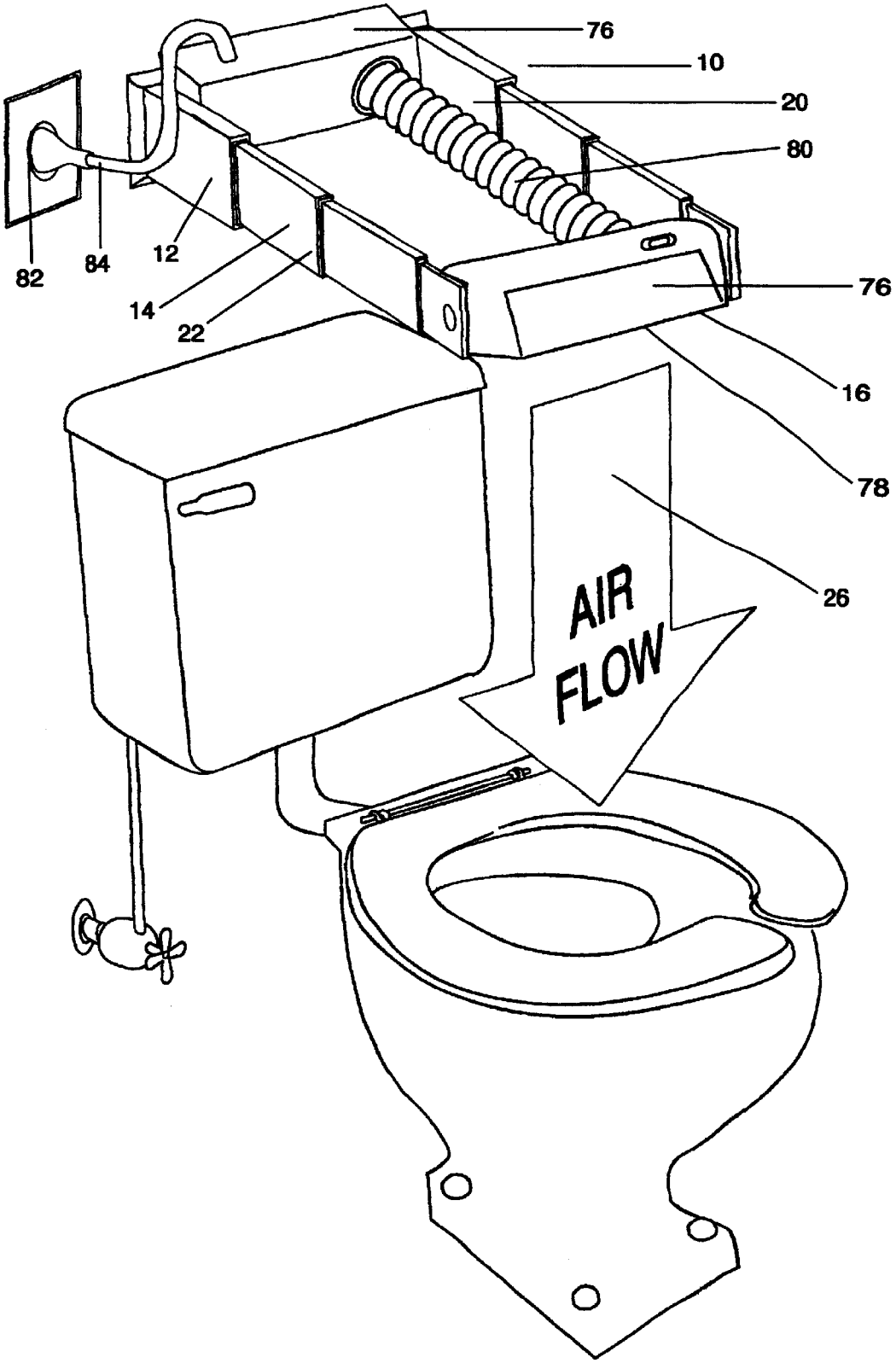
FIG. 9 is a perspective view of the fourth preferred embodiment of the invention, shown mounted over a conventional toilet.

Referring to FIG. 9

Another embodiment of apparatus 10 may be produced by omitting the spool of absorbent paper 50 and interacting components. Attached to forward telescoping members 24*d* is an alternative ($3^{rd}$ segment mini type urinal receptacle device) 68 positioned perpendicularly, of small scale- and substantially lightweight, having and attached to integral plumbing components, such as a water supply line 72 valve(s) 74 (single or double), flexible inlet tube 66 spud, flush valve 70 flush spreader, non drip tailpiece and any other component necessary. The urinal type receptacle device is positioned above the toilet bowl during use providing the user with a precise target of superior angle (mini type urinal) for deflecting and guiding the stream of urine into the toilet bowl.

In reference to all embodiments contemplated, the aforementioned 1st and 2nd segments may be designed and manufactured of single piece construction. Therefore, for purposes of describing the present invention, the 1st and 2nd segments equal 1 segment.

also

In reference to all embodiments contemplated, the aforementioned 1st and 2nd segments connected to structural components which provide stability and immediate support for 3rd Segment.

May be designed and manufactured of single piece construction, therefore for purposes of describing the present invention, the 1st segment, 2nd segment and said structural components equal 1 segment.

LIST OF REFERENCE NUMERALS

10—Extensible and Retractable Urine Deflecting Apparatus
12—Attach, Connect, and Support Structure
13—Bearings
14—Extensible and Retractable Mechanical Arms
16—Urine Deflecting Device
17—Variable Height Track System
18—Flange
19—Variable Height Track w/ Attach,Connect,& Support Structure
20—Protruding Unit
22—Telescoping Members
24*a*—Rear Telescoping Members
24*d*—Forward Telescoping Members
26—Urine Deflecting Means
28—Bracing Member
30—Struts
31—Paper Weight Engagement Pads or Gripping Pads
32—Friction Engagement Pads or Griping Pads
32*a*—Top Friction Engagement Pad or Gripping Pads
32*b*—Bottom Friction Engagement Pad or Gripping Pads
34—Smooth Surfaced Tubes
36—Clamping Arm
38—Push and Pull Straight Line Action Clamp
40—Sliding Bolt
42—Centering attachment
44—Base of Straight Line Action Clamp
45—Shaft
46—Removable Shaft
48—Niches
50—Spool of Absorbent Paper
52—Serrated Blade
54—Pair of Clamps
56—Paper Supporting Device
58—Individual Sheet(s) of Paper
60—Pins
62—Water Cascading Faucet Device
64—Elongated Sheetflow Spout
66—Flexible Inlet Tube
68—Mini Type Urinal Receptacle Device
70—Flush Valve
72—Water Supply Line
74—Valve(s)
76—Stream of Air Generating Device
78—Elongated Air Flow Nozzle
80—Flexible Hose
82—Dedicated Electrical Circuit
84—Cord (electrical)

What is claimed is:

1. A urinal device for converting a toilet into a urinal, comprising:

a. a protractedly permeable urine barrier sheet means having an outermost exterior surface for receiving a stream of urine delivered by a human being from a substantially standing up position, and b. a support structure means for supporting said protractedly permeable urine barrier sheet means substantially above a toilet bowl and for supporting entire said urinal device substantially unattached from the toilet bowl seat, whereby urine contacting said protractedly permeable urine barrier sheet means having an outermost exterior surface for receiving'" a stream of urine will be diverted to said toilet bowl.

2. A device as in claim 1, including:

means connected to said protractedly permeable urine barrier sheet means support structure means to move said protractedly permeable urine barrier sheet means from a first position over said toilet bowl to a second position away from said toilet bowl to permit access to said toilet bowl.

3. A device as in claim 2, including:

means to permit movement of said protractedly permeable urine barrier sheet means vertically.

4. A device as in claim 2, including:

means to permit movement of said protractedly permeable urine barrier sheet means horizontally.

5. A device as in claim 1, wherein said protractedly permeable urine barrier sheet means includes a disposable barrier medium.

6. A device as in claim 1 wherein said protractedly permeable urine barrier sheet means is a paper medium.

7. A device as in claim 1 wherein said protractedly permeable urine barrier sheet means is a fluid medium.

8. A device as in claim 7 wherein said fluid medium is water.

9. A device as in claim 1 wherein said protractedly permeable urine barrier sheet means is an invisible medium.

10. A device as in claim 9 wherein said invisible medium is propelled air.

11. A device as in claim 1, therein said protractedly permeable urine barrier sheet means includes a receptacle barrier medium.

12. A device as in claim 11, wherein said receptacle barrier medium is a light weight mini urinal device.

13. A device as in claim 11, including:

said receptacle barrier being variable in height above said toilet bowl.

14. A method for converging a toilet with an adaptable vertically oriented urine barrier device, comprising the steps of a. providing a vertically oriented protractedly permeable urine barrier sheet means having an outermost exterior surface for receiving a stream of urine above said toilet, b. providing a support means for supporting said protractedly permeable urine barrier sheet means and for supporting- entire said vertically oriented urine barrier device substantially unattached from a toilet bowl seat, and c. positioning said protractedly permeable urine barrier sheet means substantially above the toilet bowl and primarily above the uppermost height of said fully lowered toilet bowl seat, whereby said toilet and said protractedly permeable urine barrier sheet means supported by said support means can be utilized as a urinal by a human being from a non sitting position.

15. The method as in claim 14, including the step of:

providing an absorbent paper medium as the protractedly permeable urine barrier sheet means.

16. The method as in claim 15, including the step of a. dispensing the absorbent paper urine barrier sheet from a supporting means suspended above the toilet and allowing the used absorbent paper medium to be removed.

17. The method as in claim 14 including the step of:

a. providing a fluid medium as the protractedly permeable urine barrier sheet means.

18. The method as in claim 14, including the step of a. providing single paper sheets as the Protractedly permeable urine barrier sheet means positioned individually above said toilet bowl when in use.

19. The method as in claim 14, including the steps of:

providing a medium such as a sheetflow of water as the protractedly permeable urine barrier sheet means.

20. The method as in claim 14, including the step of:

providing a medium such as forced air current as the protractedly permeable urine barrier sheet means.

21. The method as in claim 14, including the step of:

providing a medium such as a receptacle structure as the protractedly permeable urine barrier sheet means.

22. A method for creating a urinal by combining a toilet and a paper dispensing urinal device, comprising the steps of a. providing at least one attaching connecting and supporting means as an integral component of said paper dispensing urinal device for facilitating stability, b. providing at least one extending and retracting mechanical arm means as an integral component of said paper dispensing urinal device for facilitating motion, c. providing a protractedly permeable paper urine barrier sheet means having an outermost exterior surface for receiving a stream of urine being delivered by a human being from a substantially non sitting position into the toilet bowl, and d. placing entire said paper dispensing urinal device in close proximity to said toilet.

23. A method for creating a fully functioning urinal by combining a toilet and a protractedly permeable paper urine barrier sheet having an outermost exterior surface for receiving a stream of urine, comprising the steps of:

a. providing a protractedly permeable paper urine barrier sheet means having an outermost exterior surface for receiving a stream of urine being delivered by a human being, b. placing said protractedly permeable paper urine barrier sheet, having an outermost exterior surface for receiving a stream of urine, substantially above a toilet bowl and positioned primarily above the uppermost height of a fully lowered toilet bowl seat, and c. urinating onto said protractedly permeable paper urine sheet barrier from an angle which is substantially facing the front part of said toilet bowl and from a substantially standing up position.

24. A urine deflecting device for a toilet, comprising:

a. a protractedly permeable urine barrier sheet means having an outermost exterior surface for receiving and conveying a urine stream directed at said protractedly permeable urine harrier sheet means and down along said protractedly permeable urine barrier sheet means, and b. at least one structural support means, positioned unattached to the toilet bowl seat, for suspending said protractedly permeable urine barrier sheet means above the toilet bowl in a vertical orientation, whereby a stream of urine directed at said protractedly permeable urine barrier sheet means is conveyed down along said protractedly permeable urine barrier sheet means into the toilet bowl to avoid splashing of urine.

25. The device of claim 24 wherein said protractedly permeable urine barrier sheet means is absorbent paper.

26. The device of claim 25 wherein said absorbent paper is unwound from a spool.

27. The device of claim 26 further including a shaft for supporting and unraveling said spool of absorbent paper.

28. The device of claim 24 wherein said protractedly permeable urine barrier sheet means is flowing liquid.

29. The device of claim 24 wherein said protractedly permeable urine barrier sheet means is mechanically propelled air.

30. The device of claim 24 wherein said protractedly permeable urine barrier sheet means is a self cleaning receptacle structure.

31. The device of claim 24 wherein said means for suspending said protractedly permeable urine barrier sheet means in a vertical orientation is at least one mechanical arm.

32. The device of claim 31 wherein said mechanical arm is extensible and retractable.

33. The device of claim 31 including a ball bearing mechanism movably connected to said mechanical arm wherein said mechanical arm is extensible and retractable.

34. The device of claim 31 including synthetic bearings having high lubricity movably connected to said mechanical arm wherein said mechanical arm is extensible and retractable.

35. The device of claim 31 including a roller bearing mechanism movably connected to said mechanical arm wherein said mechanical arm is extensible and retractable.

36. The device of claim 24 wherein said means for suspending said protractedly permeable urine barrier sheet means above a toilet bowl in a vertical orientation positioned substantially unattached from a toilet bowl seat further comprises an attach, connect, and support structure means.

37. The device of claim 36 wherein said attach, connect, and support structure further comprises flanges for flush mounting entire said urine deflecting device.

38. The device of claim 36 wherein said attach, connect, and support structure further comprises niches for inserting a spool supporting shaft.

39. The device of claim 24 including a means connected to said means for suspending said protractedly permeable urine barrier sheet means that allows the protractedly permeable urine barrier sheet means to be movable vertically for a variable height.

40. The device of claim 24 further including a paper cutter for cutting paper.

41. The device of claim 24 further including a pair of gripping pads connected to at least one extensible and retractable mechanical arm.

42. A method for reliably depositing urine into a toilet bowl being delivered by a human being from a substantially standing up position, comprising the steps of:

a. providing an attachable extensible and retractable urine deflecting device having a protractedly permeable urine barrier sheet means connected to its forward end with an outermost exterior surface for receiving a stream of urine and for deflecting said stream of urine, b. placing the protractedly permeable urine barrier sheet means segment of said urine deflecting device above said toilet bowl and primarily above the uppermost height of a fully louvered toilet bowl seat, and c. urinating onto said protractedly permeable urine barrier sheet means.

43. A method for redirecting urine being delivered by a human being into a toilet bowl from a substantially non sitting position and from an angle which is substantially facing the front part of said toilet bowl, comprising the steps of.

a. providing a protractedly permeable urine barrier sheet means having an outermost exterior surface for receiving a stream of urine, b. placing said urine barrier sheet means substantially above said toilet bowl and above the uppermost height of a fully lowered toilet bowl seat for use as a target, and c. aiming urine at said protractedly permeable urine barrier sheet means.

44. An attachable extensible and retractable linear motion device having a rigid structural member protruding from said attachable extensible and retractable linear motion device for supporting a urine deflector supply means and having a rigid structural member protruding from the forward end of said attachable extensible and retractable linear motion device for supporting and positioning a urine deflecting means having an outermost exterior surface for receiving a stream of urine above a toilet bowl, comprising:

a. at least one attachable extensible and retractable linear motion mechanical arm means having at least one rigid structural member protruding from said attachable extensible and retractable linear motion device for supporting a urine deflector supply means and having at least one rigid structural member protruding from the forward end of said attachable extensible and retractable linear motion device for supporting and positioning a urine deflecting means having an outermost exterior surface for receiving a stream of urine above a toilet bowl, whereby said attachable extensible and retractable linear motion device having a rigid structural member protruding from said attachable extensible and retractable linear motion device and having a rigid structural member protruding from the forward end of said attachable extensible and retractable linear motion device functions to support said urine deflector supply means and functions to support and position said urine deflecting means having an outermost exterior surface for receiving a stream of urine above said toilet bowl.

45. A mountable mechanical arm device having a rigid structural member protruding from said mountable mechanical arm device for supporting a urine deflector supply means and having a rigid structural member protruding from the forward end of said mountable mechanical arm device for supporting and positioning a urine deflecting means having an outermost exterior surface for receiving a stream of urine above a toilet bowl, comprising:

a. at least one attaching, connecting, and supporting structure means having at least one rigid structural member protruding from said at least one attaching, connecting, and supporting structure means for supporting a urine deflector supper means disposed in proximity to the toilet, end b. at least one linear motion extensible and retractable mechanical arm means having at least one rigid structural member protruding from its forward end for supporting and positioning said urine deflecting means with an outermost exterior surface for receiving a stream of urine above said toilet bowl, whereby said mountable mechanical arm device having a rigid structural member protruding from said mountable mechanical arm device and having a rigid structural member protruding from the forward end of said mountable mechanical arm device functions to support said urine deflector supply means and functions to support and position said urine deflecting means having an outermost exterior surface for receiving a stream of urine above said toilet bowl.

46. An attachable extensible and retractable urine deflecting device having a protractedly permeable urine deflecting sheet means with an outermost exterior surface for receiving a stream of urine delivered by a human being from a substantially standing up position and to be utilized in combination with a toilet, comprising:

a. at least one attachable extensible and retractable mechanical arm means disposed in proximity to said toilet, for positioning said protractedly permeable urine deflecting sheet means, which serves as a urine deflector above a toilet bowl, and b. a protractedly permeable urine deflection sheet means having an outermost exterior surface for receiving a stream of urine substantially above said toilet bowl and primarily above the uppermost height of a fully lowered toilet bowl seat, whereby said attachable extensible and retractable urine deflecting device having a protractedly permeable urine deflecting sheet means with an outermost exterior surface for receiving a stream of urine above said toilet readily creates and produces a fully functional urinal device for a human being to utilize from a substantially standing up position for reliably deflecting and depositing urine into said toilet bowl.

47. A urine deflecting device having a protractedly permeable urine deflecting sheet means with an outermost exterior surface for receiving a stream of urine delivered by a human being from a substantially standing up position, and to be utilized in combination with a toilet, comprising:

a. at least one attaching, connecting and supporting-means disposed substantially unattached from a toilet bowl seat, and b. a protractedly permeable urine deflecting sheet means having, an outermost exterior surface for receiving a stream of urine delivered by a human being onto said protractedly permeable urine deflecting sheet means from an angle which is substantially facing the front part of said toilet bowl and positioning said protractedly permeable urine deflecting sheet means substantially above the toilet bowl and primarily above the uppermost height of a fully lowered toilet bowl seat, whereby said urine deflecting device having a protractedly permeable urine deflecting sheet means with an outermost exterior surface for receiving a stream of urine in combination with said toilet, readily creates and produces a fully functional urinal device for a human being to utilize front a substantially standing up position for reliably deflecting and depositing urine into said toilet bowl.

48. A urine deflecting device having a protractedly permeable urine deflecting sheet means with an outermost exterior surface for receiving a stream of urine delivered by a human being from a substantially standing up position, and to be utilized in combination with a toilet, comprising:

a. at least one attachable support means disposed substantially unattached from the entire toilet, for supporting said protractedly permeable urine deflecting sheet means having an outermost exterior surface that serves as a urine stream receiver delivered by a human being from a substantially standing up position, and b. a protractedly permeable urine deflecting sheet means having an outermost exterior surface for receiving a stream of urine delivered by a human being onto said protractedly permeable urine deflecting sheet means from an angle which is substantially facing the front part of a toilet bowl and positioning said protractedly permeable urine deflecting sheet means substantially above said toilet bowl and primarily above the uppermost height of a fully lowered toilet bowl seat, whereby said urine deflecting device having a protractedly permeable urine deflecting sheet means with an outermost exterior surface for receiving a stream of urine in combination with said toilet, readily creates and produces a fully functional urinal device for a human being to utilize from a substantially standing up position for reliably deflecting and depositing urine into said toilet bowl.

49. An extensible and retractable urine deflecting device having a protractedly permeable urine deflecting sheet means with an outermost exterior surface for receiving a stream of urine delivered by a human being from a substantially standing up position and to be utilized in combination with a toilet, comprising:

a. at least one attach, connect, and support structure means disposed substantially unattached from a toilet bowl seat, for supporting entire said extensible and retractable urine deflecting device, and b. at least one extensible and retractable mechanical arm means secured to said at least one attach, connect, and support structure means, for supporting and for moving said protractedly permeable urine deflecting sheet means to various locations, and c. a protractedly permeable urine deflecting sheet means having an outermost exterior surface for receiving a stream of urine delivered by a human being onto said protractedly permeable urine deflecting sheet means from an angle which is substantially facing the front part of said toilet bowl and positioned substantially above said toilet bowl and primarily above the uppermost height of a fully lowered toilet bowl seat, whereby said extensible and retractable urine deflecting device having a protractedly permeable urine deflecting sheet means with an outermost exterior surface for receiving a stream of urine in combination with said toilet readily creates and produces a fully functional urinal device for a human being to utilize from a substantially standing up position for reliably deflecting and depositing urine into said toilet bowl.

50. An extensible and retractable urinal device having a protractedly permeable urine deflecting sheet means faith an outermost exterior surface for receiving a stream o urine in combination with a toilet, comprising:

a. an attachment structure means disposed in proximity to the toilet, for supporting entire said urinal device, and b. an extension and retraction means secured to said attachment structure means, for interconnecting said attachment structure means with said protractedly permeable urine deflecting sheet means which serves as a urine stream receiver delivered by a human being from a substantially non sitting position, and c. a protractedly permeable urine deflecting sheet means having an outermost exterior surface for receiving a stream of urine and secured to said extension and retraction means.

51. The extensible and retractable urinal device of claim 50, wherein the protractedly permeable urine deflecting sheet means further comprises a paper dispensing device.

52. The extensible and retractable urinal device of claim 51, wherein the paper dispensing device further comprises:

a spool mounting mechanism connected to the attachment structure means, a spool of protractedly permeable paper rotatably mounted onto the spool mounting mechanism, and a paper guide mechanism for guiding a segment of said protractedly permeable paper extended from the spool, downwardly into water in the toilet.

53. The extensible and retractable urinal device of claim 51, wherein the paper dispensing device further comprises:

a spool of protractedly permeable paper removably mounted on the shaft, a paper engaging structure mounted on the extension and retraction means in proximity to the spool and including gripping pads, the paper engaging structure including a blade supported by a friction engagement plate, a pair of opposing friction engagement plates mounted on the extension and retraction means, a niche on the surface of said attachment structure means for supporting said spool mounting mechanism, such that paper from said spool is unrolled forwardly and fitted between said friction engagement plates, which presses against the paper to create friction between the plates and the paper, thereby preventing unwanted and inadvertent dispensing of said paper, and such that a segment of said paper is permitted to angle downwardly, hanging vertically into water in the toilet bowl.

54. The extensible and retractable urinal device of claim 50, wherein the protractedly permeable urine deflecting sheet means further comprises a supporting member such that the protractedly permeable urine deflecting sheet means is substantially vertically positioned above the toilet bowl by said supporting member.

55. The extensible and retractable urinal device of claim 54, wherein the paper supporting device further comprises:

a paper fastening mechanism means connected to the extension and retraction means, a sheet of protractedly permeable paper individually mounted onto the paper fastening mechanism means, and a paper guide mechanism for guiding an individual sheet of protractedly permeable paper extended from said paper supporting device substantially downwardly towards the water in the toilet bowl, in a substantially vertical position.

56. The extensible and retractable urinal device of claim 54, wherein the paper supporting device further comprises:

an independent paper dispenser mounted on said attachment structure, such that individual sheets of protractedly permeable paper are readily accessible for use and for mounting to said paper fastening mechanism means in a substantially perpendicular position above a toilet bowl.

57. The extensible and retractable urinal device of claim 50, wherein the protractedly permeable urine deflecting sheet means further comprises:

a water cascading means selectively directing a sheet flow of water downwardly into the toilet to deflect and guide the urine stream into the toilet bowl.

58. The extensible and retractable urinal device of claim 57, wherein the water cascading means is a water cascading faucet device.

59. The extensible and retractable urinal device of claim 58, which further comprises a water cascading faucet device with a handle and water supply line and a substantially elongated and substantially vertically directed water discharge spout.

60. The extensible and retractable urinal device of claim 50, wherein the protractedly permeable urine deflecting sheet means further comprises a water cascading faucet device mounted on the extension and retraction means having an elongated sheetflow spout positionable over the toilet such that, when the extension and retraction means is extended, said water cascading faucet device and sheetflow of water delivered from said faucet device intercepts the stream of urine and the urine is deflected and guided into the toilet bowl.

61. A method for deflecting and redirecting urine into a toilet, comprising the steps of:

a. reaching for an extension and retraction structure connected to a protractedly permeable urine deflecting sheet means having an outermost exterior surface for receiving a stream of urine disposed in its retracted position in proximity to the toilet, b. grasping the structure connected to said protractedly permeable urine deflecting sheet means, c. moving the structure such that the protractedly permeable urine deflecting sheet means moves from its retracted position to a position substantially over the toilet bowl, d. urinating onto said protractedly permeable urine deflecting sheet means, e. moving the structure such that said protractedly permeable urine deflecting sheet means is moved back to its retracted position.

62. A device for converting a toilet into a urinal, comprising:

a. a dispensed protractedly permeable urine barrier sheet means having an outermost exterior surface for receiving a stream of urine, and placed primarily above the uppermost height of a fully lowered toilet bowl seat, and b. a supporting means which is substantially unattached from said toilet bowl seat for supporting said dispensed protractedly permeable urine barrier sheet means having an outermost exterior surface that serves to receive a stream of urine primarily above the uppermost height of a fully lowered toilet bowl seat, whereby urine contacting said dispensed protractedly permeable urine barrier sheet means having an outermost exterior surface for receiving a stream of urine will be diverted into said toilet bowl.

63. A device for converting a toilet into a urinal, comprising:

a. a protractedly permeable urine barrier sheet means having an outermost exterior surface for receiving a stream of urine, and placed primarily above the uppermost height of a fully lowered toilet bowl seat, and b. a supporting means which is substantially unattached from said toilet bowl seat for supporting said protractedly permeable urine barrier sheet means having an outermost exterior surface that serves to receive a stream of urine primarily above the uppermost height of a fully lowered toilet bowl seat, whereby urine contacting said protractedly permeable urine barrier sheet means having an outermost exterior surface for receiving a stream of urine will be diverted into said toilet bowl.

64. An extendable and retractable device having a protractedly permeable urine deflector sheet means with an outermost exterior surface for receiving a stream of urine, comprising:

a. an extendable and retractable mechanical arm means connected to said protractedly permeable urine deflector sheet means, for supporting said protractedly permeable urine deflector sheet means and for positioning said protractedly permeable urine deflector sheet means from a position in proximity to said toilet bowl to a position away from said toilet bowl, and b. a support means which is substantially unattached from a toilet bowl seat connected to said extendable and retractable mechanical arm means for supporting entire said extendable and retractable device having a protractedly permeable urine deflector sheet means.

* * * * *